United States Patent [19]

Henning et al.

[11] 4,456,433

[45] Jun. 26, 1984

[54] METHOD FOR ASSEMBLING A SINGLE-FLOW TURBOMOLECULAR VACUUM PUMP, AND A TURBOMOLECULAR VACUUM PUMP ASSEMBLED BY SAID METHOD

[75] Inventors: Hans-Heinrich Henning, Cologne; Hansen Pfaff, Erftstadt, both of Fed. Rep. of Germany

[73] Assignee: Leybold Heraeus GmbH, Cologne, Fed. Rep. of Germany

[21] Appl. No.: 303,666

[22] Filed: Sep. 18, 1981

[30] Foreign Application Priority Data

Oct. 17, 1980 [DE] Fed. Rep. of Germany ..... 3039196

[51] Int. Cl.[3] ..... F04B 35/04; F01D 1/36

[52] U.S. Cl. ..... 417/53; 417/360; 417/424; 415/90; 415/201

[58] Field of Search ..... 417/423 R, 89, 423 A, 417/424, 360, 53; 415/90, 110, 1, 118, 201, DIG. 3; 73/66

[56] References Cited

U.S. PATENT DOCUMENTS

| | | | |
|---|---|---|---|
| 1,603,076 | 10/1926 | Hanson | 415/201 |
| 2,977,042 | 3/1961 | Jassniker | 415/201 |
| 3,417,704 | 12/1968 | Pall et al. | 417/423 R |
| 3,667,870 | 6/1972 | Yoshida et al. | 417/423 R |
| 4,116,592 | 9/1978 | Cherny et al. | 415/90 |
| 4,332,522 | 6/1982 | Saulgeot | 415/90 |

FOREIGN PATENT DOCUMENTS

| | | | |
|---|---|---|---|
| 124943 | 11/1967 | Czechoslovakia | 73/66 |

OTHER PUBLICATIONS

*Schenck Electrodynamic Balancing Machines*, 1957.

*Primary Examiner*—Edward K. Look
*Assistant Examiner*—Paul F. Neils
*Attorney, Agent, or Firm*—Felfe & Lynch

[57] ABSTRACT

A method for assembling a single-flow turbomolecular vacuum pump and a turbomolecular vacuum pump assembled by a method wherein the pump rotor, rotor shaft, antifriction bearings and motor armature are first assembled to form a unit, balanced outside of the pump casing, and thereafter introduced as a unit into the pump casing and mounted therein.

4 Claims, 1 Drawing Figure

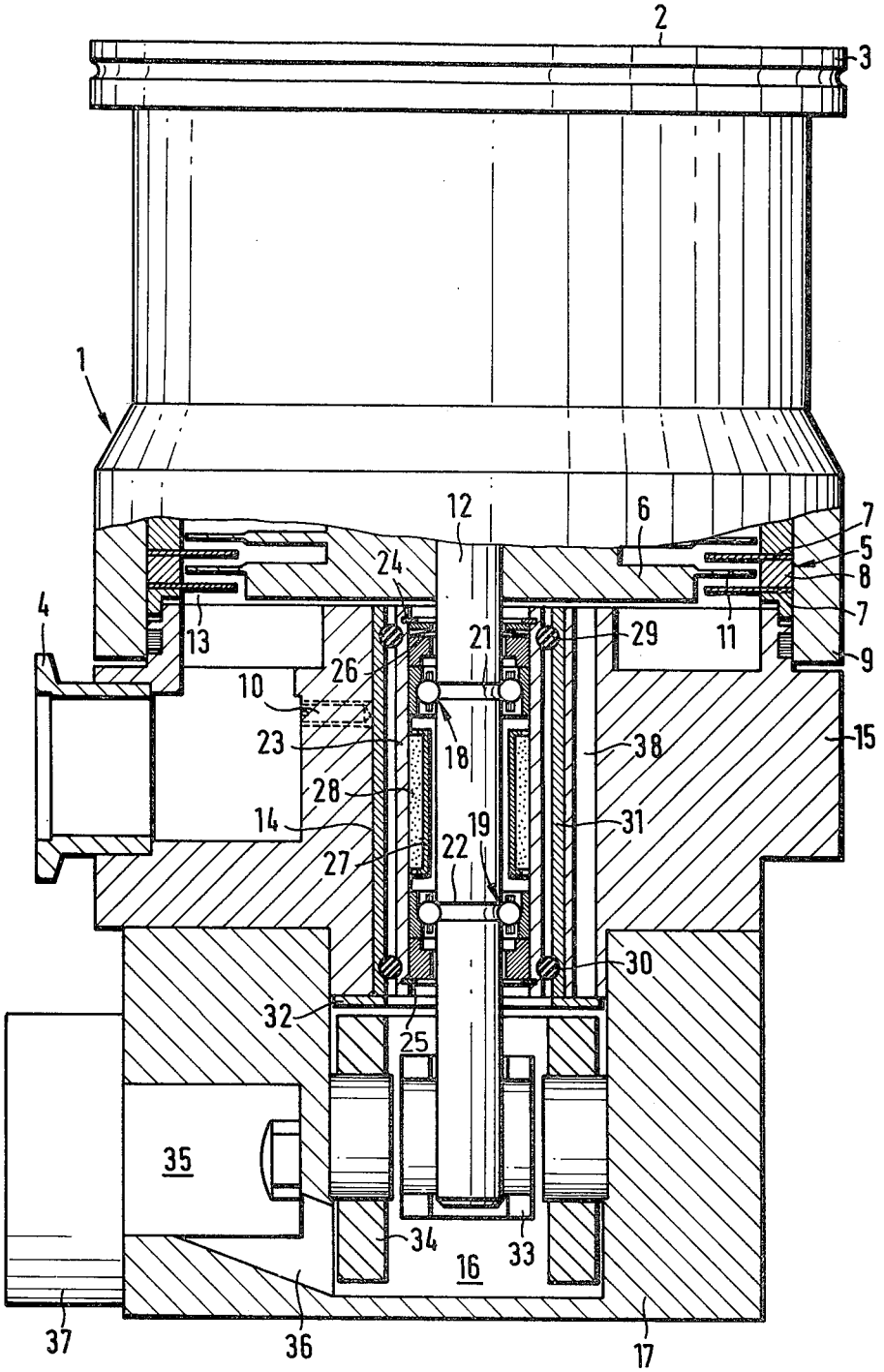
2
3
1
12
6
7
5
8
7
9
24
4
13
21
29
11
26
10
23
18
38
15
28
14
19
31
27
22
30
32
25
35
34
33
16
37
36
17

METHOD FOR ASSEMBLING A SINGLE-FLOW TURBOMOLECULAR VACUUM PUMP, AND A TURBOMOLECULAR VACUUM PUMP ASSEMBLED BY SAID METHOD

BACKGROUND OF THE INVENTION

The invention relates to a method for assembling a single-flow turbomolecular vacuum pump in which components such as the rotor, the drive motor and the rotor shaft, supported by antifriction bearings, are accommodated in a casing. The invention further relates to a pump assembled by that method.

In a prior-art method, a turbomolecular pump is initially assembled without its stator. Following this, the rotating system is rough-balanced under atmospheric pressure at speeds of up to a few thousand revolutions per minute. As used herein, balance always refers to the art of rotationally balancing rotary parts. Then the pump is completely assembled, provided with a blind flange, and placed in operation so that the balancing of the rotor can be continued under vacuum conditions and at rated speed. This calls for a number of balancing operations since the point of unbalance of the rotating parts of a completely assembled turbomolecular pump cannot always be pinpointed. The reasons for this are the necessary resilient mounting of the rotating system in the pump casing and the phase shifts resulting therefrom. After each balancing operation the pump must be stopped and opened to permit the unbalance to be corrected on the rotating system, by drilling, for example.

Besides, measuring and removing unbalance requires costly equipment. This is why turbomolecular vacuum pumps can be balanced only on the manufacturer's premises. Pumps which are already in service on a user's premises and on which maintenance or repair work is to be performed must therefore be shipped back to the manufacturer every time, so that the user has to contend with long outages.

SUMMARY OF THE INVENTION

The object of the present invention is to modify and improve the assembling method in such a way that balancing is considerably simplified and long outages are avoided.

In accordance with the invention, this object is accomplished in that the rotor, the rotor shaft, the antifriction bearings and the motor armature are first assembled to form a unit and are then balanced outside the pump casing, and that this system is then introduced into the casing and mounted therein as a unit. Making it possible for the rotating parts to be balanced outside the pump casing considerably simplifies balancing, for one thing. For another, it permits resilient mounting of the rotating parts during balancing to be dispensed with, with the result that points of unbalance can be located and compensated for more quickly. Surprisingly, it has been found that it is not absolutely necessary that balancing of the rotor system be performed under vacuum conditions. Even direct balancing at rotative speeds below the rated speed will be more precise than the coventional indirect balancing in the finished pump. However, if it is nevertheless desired to balance the rotor system at rated speed and under vacuum conditions, this can readily be done under a bell without the drawbacks of balancing the rotating system in the pump itself.

A further substantial advantage of the invention is that maintenance work can be done on the customer's premises. If, for example, a bearing needs to be changed, the whole rotating system can be replaced with a new, already balanced system. It is no longer necessary to ship the pump to the manufacturer.

In an advantageous variant of the method of the invention, the antifriction bearings are provided with a cage that is common to both and through which the rotating system is held in the balancing machine, a bearing housing then being resiliently mounted on the cage, and the rotating system then being mounted in the pump casing by means of said bearing housing. This assembling method facilitates the mounting of the necessary resilient supporting means for the rotating system in the pump casing.

A turbomolecular vacuum pump assembled by the method in accordance with the invention is characterized in that the rotor, the rotor shaft, the motor armature and the antifriction bearings form a unit which can be installed as such.

Details and advantages of the invention will now be described with reference to an embodiment, illustrated diagrammatically in the accompanying drawing, of a turbomolecular vacuum pump assembled by the method in accordance with the invention.

BRIEF DESCRIPTION OF THE DRAWING

The FIGURE is a partial cross-sectional view of a turbomolecular vacuum pump in accordance with the present invention.

DETAILED DESCRIPTION OF THE INVENTION

In the diagrammatic representation of the turbomolecular vacuum pump 1, the intake is designated 2, the intake flange 3, and the discharge pipe 4. Of the pump 5 and rotor 6, only relatively small portions are shown. The stator 5 is formed of split blade rings 7 between which spacer rings 8 are disposed. The system formed by the blade rings 7 and the spacer rings 8 is held together by a substantially cylindrical casing section 9. The rotor 6 with its blades 11 is of one-piece construction and is mounted on a shaft 12.

The shaft 12 extends from a rotor space 13 in casing section 9 through a bearing space 14 in a casing section 15 to a motor space 16 in a casing section 17. In the bearing space 14, the antifriction bearings 18 and 19 are disposed. Associated with the balls of these bearings are raceways 21 and 22 in the shaft 12 to form obviously rigid bearings. With this arrangement, the shaft diameter can be relatively large even with small bearings. Associated with the antifriction bearings 18 and 19 is a bearing cage 23 in which these bearings are combined by means of lock washers 24 and 25 to form a unit. A disk spring 26 serves to secure the bearings in position axially. Mounted on the bearing cage 23 between the bearings 18 and 19 is a substantially cylindrical lubricant reservoir 27. The latter is filled with a lubricant-impregnated material 28. Through O rings 29 and 30, the bearing cage 23 is supported in a bearing housing 31. Associated with the latter on the side facing the motor space 16 is a stop 32 which assures proper axial positioning of the rotating system. The bearing housing, and with it the entire rotating system, is secured in its position through setscrews 10 accessible through the discharge pipe 4.

Disposed in the motor space 16 are the armature or drive rotor 33, mounted on the shaft 12, and the stator 34 of the drive motor. Current is supplied to the drive motor through bores 35 and 36 in a manner not shown in detail. The plug 37, indicated diagrammatically, is designed so that the motor space 16 is sealed in a vacuum-tight manner.

In casing section 15, a bore 38 is provided parallel to the bearing space 14. Said bore serves to connect the motor space 16 to the low-vacuum side of the rotor space 13. Through that bore, the motor space 16 is maintained at initial vacuum pressure. Without such a bore, the motor space 16 would be evacuated through the bearing space, which would entail a deleterious entrainment of oil vapors.

The pump illustrated is assembled by first assembling the rotor 6, the shaft 12, the bearing space comprising the bearings 18 and 19 and the cage 23 common to both, and the motor armature to form a unit. This unit is then balanced in a balancing machine. Then the bearing housing 31, in which the bearing cage 23 is supported through O rings 29 and 30, is assembled. Following this, the entire system is mounted in the pump casing by means of the bearing housing 31. The system is secured against axial displacment by means of setscrews 10. The final assembling step involves assembling the stator from the stator rings 7 and the spacer rings 8 and pushing the cylindrical casing section 9 onto the stator.

In the embodiment illustrated, the rotor, the bearings and the armature 33 of the drive motor are axially disposed in a row. The outside diameter of the motor armature 33 is therefore smaller than the inside diameter of the bearing space 14 to permit assembly of the overall system from the vacuum side. However, the positions of bearing space and motor space may also be reversed. In that case, however, the bearing system will be quite remote from the center of mass of the rotating system.

Within the scope of the invention, it is also possible to dispense with a separate bearing housing 31. The bearing cage 23 may be supported through the O rings 29 and 30 or similar resilient elements directly on the inside wall of the bearing space 14.

It will be appreciated that the instant specification and claims are set forth by way of illustration and not of limitation, and that various changes and modifications may be made without departing from the spirit and scope of the present invention.

What is claimed is:

1. In a turbomolecular vacuum pump having a pump rotor, a drive rotor, a rotor shaft connecting the former, a pump casing, two antifriction bearings for mounting the rotor shaft in the pump casing, and means for resilience between the rotor shaft and the pump casing, the improvement wherein the pump rotor, the drive rotor, the rotor shaft, and the antifriction bearings form a rotationally balanced unit for mounting in the pump casing, the antifriction bearings being rigid, the unit further comprising a cage receiving both the antifrication bearings, and the means for resilience being between the cage and the pump casing.

2. The turbomolecular vacuum pump, according to claim 1, and further comprising an annular cylinder spacedly receiving the cage for providing a lubricant reservoir for the antifriction bearings.

3. In a method of producing a single-flow turbomolecular vacuum pump having a pump rotor, a drive rotor, a rotor shaft connecting the former, a pump casing, two antifriction bearings for mounting the rotor shaft in the pump casing, and means for resilience between the rotor shaft and the pump casing, the improvement comprising the steps of: assembling the pump rotor, the drive rotor, the rotor shaft, and the antifriction bearings to form a unit, the antifriction bearings being rigid; providing the antifriction bearings with a cage common to both bearings as part of the unit; rotationally balancing the pump rotor, drive rotor, and rotor shaft in the unit outside of the pump casing by holding the unit by the cage while rotationally balancing the same, whereby there are no resilient components in the unit to interfere with the balancing; providing the means for resilience on the cage for mounting the unit in the pump casing; and introducing the unit into the pump casing and mounting the same therein after the rotational balancing.

4. The method according to claim 1, wherein the step of rotationally balancing comprises performing the same under vacuum conditions.

* * * * *